US009446534B2

(12) United States Patent
Huse et al.

(10) Patent No.: US 9,446,534 B2
(45) Date of Patent: Sep. 20, 2016

(54) DISCONNECTION UNIT FOR INSTANTANEOUS DISCONNECTION OF A LOAD

(76) Inventors: Per Huse, Ålesund (NO); Reidar André Skarbøvik, Ålesund (NO)

( * ) Notice: Subject to any disclaimer, the term of this patent is extended or adjusted under 35 U.S.C. 154(b) by 0 days.

(21) Appl. No.: 14/348,684

(22) PCT Filed: Aug. 29, 2012

(86) PCT No.: PCT/NO2012/050155

§ 371 (c)(1),
(2), (4) Date: May 27, 2014

(87) PCT Pub. No.: WO2013/051941

PCT Pub. Date: Apr. 11, 2013

(65) Prior Publication Data

US 2014/0305291 A1 Oct. 16, 2014

(30) Foreign Application Priority Data

Oct. 5, 2011 (NO) ..... 20111354

(51) Int. Cl.

| | |
|---|---|
| ***B26F 3/00*** | (2006.01) |
| ***B63B 21/60*** | (2006.01) |
| ***F42B 1/02*** | (2006.01) |
| ***B26F 3/04*** | (2006.01) |
| ***B63B 21/22*** | (2006.01) |

(52) U.S. Cl.

CPC . *B26F 3/00* (2013.01); *B26F 3/04* (2013.01); *B63B 21/22* (2013.01); *B63B 21/60* (2013.01); *F42B 1/02* (2013.01)

(58) Field of Classification Search

CPC .... F42B 3/006; B26F 3/00; Y10T 137/1647; Y10T 83/00

USPC ..... 89/1.14, 41.02, 41.01, 1.1; 102/402, 102/403; 114/221 A; 83/18, 639.4; 137/68.13

See application file for complete search history.

(56) References Cited

U.S. PATENT DOCUMENTS 2,335,952 A * 12/1943 Martin ..... B64C 27/006 114/221 A
4,606,293 A * 8/1986 Kirkland ..... B63G 7/02 114/221 A
4,826,103 A * 5/1989 McKown ..... B64C 27/006 114/221 A (Continued)

FOREIGN PATENT DOCUMENTS

FR WO 2007096307 A1 * 8/2007 ..... A01K 73/00
FR WO 2007096335 A1 * 8/2007 ..... B21D 28/007

(Continued)

*Primary Examiner* — Samir Abdosh
*Assistant Examiner* — John D Cooper
(74) *Attorney, Agent, or Firm* — Ben Schroeder Law, PLLC

(57) ABSTRACT

A disconnection unit (10) is described for instantaneous disconnection of a load connected to a vessel (12) with the help of a wire, cable, chain or the like (16) that runs on a topside of an assigned part of an open deck (14) of a vessel, where the unit (10) comprises a housing (30) that contains an explosive part (32), said explosive part comprises, at least, one explosive unit (34) formed as a directed charge with a blast-off side, where the unit (10) is arranged to extend above the deck (14) of the vessel, and the unit (10) comprises a rod mechanism (50) arranged to hold the housing with the explosive part (32) adjoining said wire, cable, chain or the like (16) that shall be cut. Also described is an anchor handling vessel comprising, at least, one disconnection unit.

17 Claims, 4 Drawing Sheets

(56) References Cited

U.S. PATENT DOCUMENTS

| | | | | |
|---|---|---|---|---|
| 7,836,811 | B1 * | 11/2010 | Gardner | F41A 23/28 102/402 |
| 2011/0041751 | A1 * | 2/2011 | Overa | B63B 21/18 114/200 |
| 2011/0278520 | A1 * | 11/2011 | Ingeberg | B63B 21/04 254/281 |
| 2013/0098214 | A1 * | 4/2013 | Birkeland | B23D 15/00 83/18 |
| 2015/0136007 | A1 * | 5/2015 | Larsen | B63B 21/08 114/199 |

FOREIGN PATENT DOCUMENTS

| | | | |
|---|---|---|---|
| WO | WO 2007/096307 | A1 | 8/2007 |
| WO | WO 2007/096335 | A1 | 8/2007 |
| WO | WO 2010/024684 | A1 | 3/2010 |
| WO | WO 2011/062504 | A1 | 5/2011 |

* cited by examiner

DISCONNECTION UNIT FOR INSTANTANEOUS DISCONNECTION OF A LOAD

This application claims priority under 35 USC 371 to PCT/NO2012/050155 filed Oct. 5, 2012, which in turn claims priority to NO Application No. 20111354 filed Oct. 5, 2011, both of which are incorporated by reference in their entireties.

The present invention relates to a disconnection unit for instantaneous disconnection of a load connected to a vessel with the help of a wire, cable, chain or the like that runs on the topside of an assigned part of an open deck of a vessel, where the unit comprises a housing that contains an explosive part, said explosive part comprises, at least, one explosive unit formed as a directed charge with a blast-offside. The invention also relates to an anchor handling vessel equipped with a disconnection unit.

The invention finds particular application in the cutting of a wire/chain in a towing or lifting operation, such as, for example, an anchor wire or an anchor chain in an anchor handling situation.

In connection with offshore operations that involve towing or anchor handling it can happen that the tow or the anchor that is being handled goes through unexpected or unintended manoeuvres that can lead to a danger of damage to, or the loss of, a vessel that is involved in the towing activity or the anchor handling. However, such dangerous situations have often been avoided by winching out the wire or chain that connects the vessel with the uncontrolled tow or anchor, or by more drastic actions such as cutting the wire or the chain. Unfortunately serious incidents have still occurred in corresponding situations where the tow or the anchor has carried out unexpected or unintended manoeuvres at such speed that one has not had the opportunity to remove the uncontrolled load on the wire or the chain fast enough, which has thereby led to serious risks or damage to the vessel or crew and, in the worst cases, losses of ships or lives.

Similar problems have been addressed in connection with trawlers and the published international patent application PCT/EP2007/051518 describes a system for the prevention of accidents, such as for example, capsizing which can occur as a consequence of high tension in trawl cables. The system comprises a tension sensing device for a trawl cable, a vessel trim detector, an alarm system and a cable cutter. The cable cutter is of a pyrotechnic type with a housing that surrounds the cable in the direction of its circumference. A hollow charge which partially surrounds the cable is placed in the housing. The system is set up to indicate abnormal tension in the trawl cable that can lead to a capsizing, and by detonation of the hollow charge leads to a point in the cable being fired on by a ray and/or exposed to heat and/or pressure that can result in the cable being cut.

The published international patent application PCT/EP 2007/051572 describes a cable cutter of the pyrotechnical type, with a hollow charge placed in a housing which the cable is led through. The hollow charge is given a V-shaped cross section and is formed as a part of a circular arch and thus partly surrounds the cable. By being formed as a part of a circular arch the effect from the detonation of the hollow charge is focussed onto a focal point. The housing comprises a device for the positioning of a part of the cable that shall be cut centrally in relation to the focal point.

The patent publication U.S. Pat. No. 3,089,417 describes a pyrotechnical cable cutter to be used in aeroplanes with an emergency release cockpit for cutting of control cables between the cockpit and the control surfaces of the plane. The cable cutter comprises a device for fastening of an explosive to the cable at the point on the cable where it shall be cut in an emergency situation to ensure that the cockpit will be released from the other part of the fuselage. In one embodiment the cable cutter is formed by a ring-formed holder that surrounds the cable in its circumference direction and, in the main, a straight, extended hollow charge explosive with a detonator, fastened in the fastening unit in the immediate vicinity of, and tangentially to, the cable.

In the patent publication U.S. Pat. No. 2,920,532 a cable cutter is described with a V-shaped hollow charge explosive arranged in a housing and an arrangement to hold a cable up to an open end of the housing where the material from the explosive will stream out in a detonation. The V-shaped surface of the explosive is covered with a layer.

The patent publication U.S. Pat. No. 2,185,303 describes a pyrotechnical cable cutter where a piston is arranged in a cylinder, and where the cylinder has an explosive fitted in a first end which, in a detonation, drives the piston to move through the cylinder.

A knife appliance is placed at the other end of the cylinder in a housing which, in one part, also surrounds the cable. When the knife appliance is hit by the piston it is driven towards the cable so that the cable is weakened or cut.

The known cable cutters of the pyrotechnical type comprise a completely surrounding covering or guiding set up to prevent, in the main, any movement by the cable across the longitudinal direction of the cable so that it shall be in the effect point for the hollow charge explosive at all times, or they are constructed to work at a given point on the cable and are not suited for installation or use on vessels that are towing vessels or anchor handling vessels where wire, cable or chain must be carried and winched across an open deck and where there are no suitable locations to place such surrounding installations or appliances fitted onto the cable.

Particular reference is made to NO 328744 B1, issued to the present applicant and which relates to a disconnection unit installed in, or underneath, the arranged part of the deck of the vessel. The disconnection unit comprises an extended, and in its longitudinal direction, in the main, a straight outer housing that contains an extended, and in its longitudinal direction an, in the main, straight explosive part that comprises at least one explosive unit formed as a directed charge with a blast-off side, and a connection area on the blast-off side for connection of the extended outer housing to the deck of the vessel in or underneath the assigned part of the deck of the vessel.

One disadvantage with the solution described in said NO 328744 B1 is that the explosive charge, or the explosive part, is placed underneath the deck of the vessel, which means that when the chain, or the cable, shall be cut in an emergency situation the explosive force must first travel through the deck and thereafter connect with the chain for the cutting of this. In addition, when the chain is placed in towing pins and shark jaws the chain will be raised above the deck and this means that the explosive force must be great to go through the deck and further through the air and up to the chain. The result can be that there is a risk for the chain not being cut as required.

It is an object of the present invention to provide an improved disconnection unit that provides a faster and safer disconnection of a load on a vessel.

According to a first aspect of the present invention a disconnection unit is provided for immediate disconnection of a load connected to a vessel with the help of a wire, cable, chain or the like that runs on the topside of an assigned part of an open deck of a vessel, where the unit comprises a housing that contains an explosive part, said explosive part comprises, at least, one explosive unit formed as a directed charge with a blast-off side. The unit is arranged to extend above the deck of the vessel and the unit comprises a rod mechanism arranged to hold the housing with the explosive part adjoining said wire, cable, chain or the like, that shall be cut.

Alternative embodiments are given in the respective dependent claims.

The rod mechanism can comprise a number of articulated arms and the housing with the explosive part can be placed onto respective articulated arms. Furthermore, the articulated arms can be arranged in pairs in a movable scissor arrangement, whereby the housing with the explosive part is withdrawn into the unit in an inactive state and extended from the unit in an active state.

The disconnection unit can preferably be raised from and lowered into the deck of the vessel.

The disconnection unit can comprise a release mechanism arranged to initiate the extension of the articulated arms. In an inactive state the articulated arms can be arranged biased in the disconnection unit.

The disconnection unit can also comprise two sets with a number of articulated arms, where the housing with the explosive part is placed between the respective outermost articulated arms to each set of articulated arms.

The release mechanism can be arranged to be triggered when the disconnection unit is, or becomes, raised above the deck of the vessel. The release mechanism can comprise a peg with a locking wheel, where the locking wheel is arranged to be released from a locked position.

Furthermore, the housing can be fitted with a number of pegs and a number of slits arranged for connecting to said articulated arms.

The housing can be an extended and, in its longitudinal direction, in the main, a straight outer housing that contains an extended, and in its longitudinal direction, in the main, a straight explosive part, where the explosive part comprises an explosive element that forms, in a section across the longitudinal direction of the housing, an, in the main, V-shape outline to form an, in the main, V-shaped or cone shaped hollow space, and that the explosive part is arranged so that the opening direction of the, in the main, V-shaped or cone shaped hollow space decides the blast-off direction for a shockwave, material or heat.

A layer of shock or heat absorbing material can alternatively be arranged between the outer housing and the explosive part.

According to a second aspect of the present invention an anchor handling vessel is provided comprising a disconnection unit as given above, where the disconnection unit is arranged on or adjoining the aft end of the deck of the vessel, in which the disconnection unit is located in an area between the shark jaws and towing pins of the vessel and where the housing with the explosive part is arranged to be held against a wire, cable, chain or the like that runs between said shark jaws and towing pins.

Alternative embodiments of the anchor handling vessel are given in the respective dependent claims.

The disconnection unit can be integrated in a box with said shark jaws and towing pins. Furthermore, a disconnection unit can be arranged so that it can be raised and lowered on each side of said wire, cable, chain or the like.

The thermic reactive mass in the explosive part according to the invention is formed and arranged so that at a thermic reaction a pressure is generated in the direction towards said wire, chain, or the like and which typically leads to such tensions in the goal material, and partly also such heat effects that the yield point limit for the goal material is exceeded. Under this influence the goal material dissolves so that, in the case of said chain, wire or the like, said cable, chain, wire or the like is cut more or less instantaneously.

The thermic, fast reacting mass is arranged so that in the reaction it generates a geometric focus towards a point of convergence, a line of convergence or a plane of convergence by pressure, possibly also material and water that is blasted out by the reaction. The individual explosive unit generates a thermic reactive mass with, for example, a V-shaped, pyramid shaped or cone shaped surface on the blast-off side and is arranged to send out a shockwave, material or heat in a collected flow towards the convergence area, which is, for example, adapted so that the point of convergence lies in, or near, the centre of the item that shall be cut. To reinforce the above mentioned effect, metallic additives can be placed in such a way that a considerable reinforcement of the effect at the point of convergence for the geometric focus in the thermic reactive mass is achieved.

In the following, the term explosive is used, in the main, as a common term for such thermic masses that are suitable for the embodiment of invention.

The invention shall now be described in more detail with the help of the enclosed figures, in which.

Figure 1:
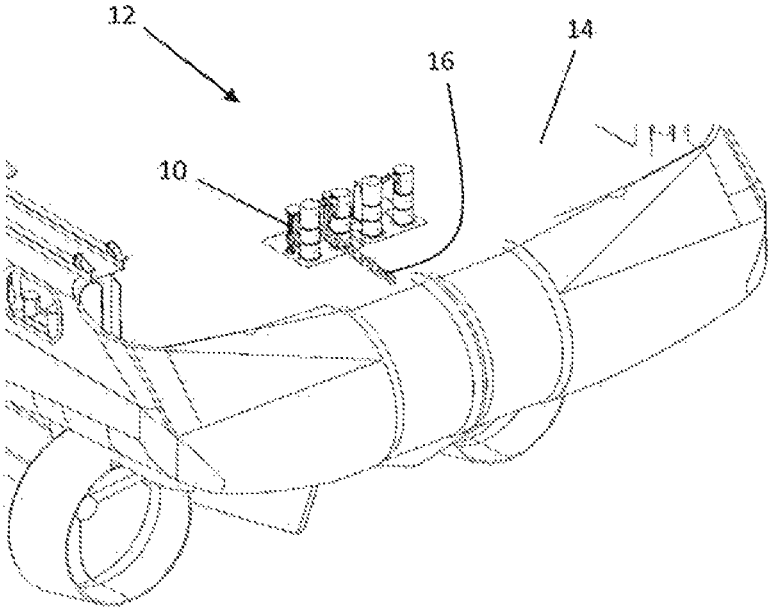
FIG. 1 shows the aft end of a vessel fitted with the present invention.
Figure 2:
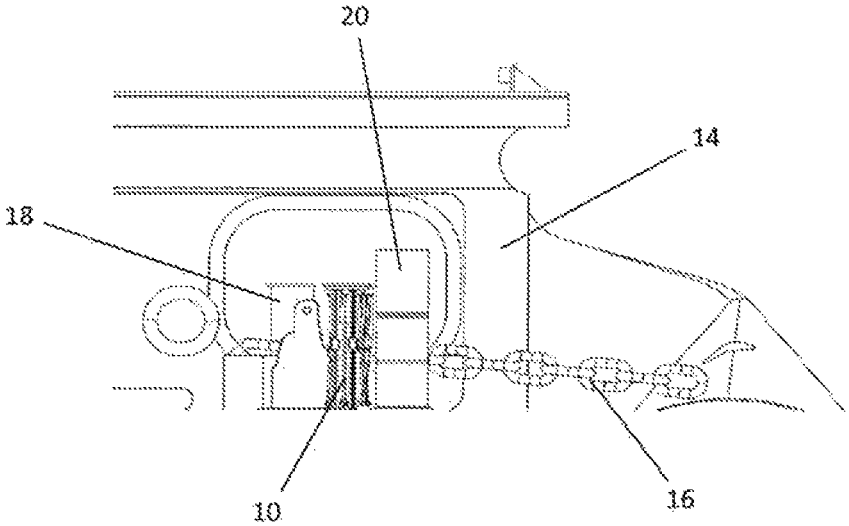
FIG. 2 shows in more detail the invention fitted to the aft end of the vessel.
Figure 3:
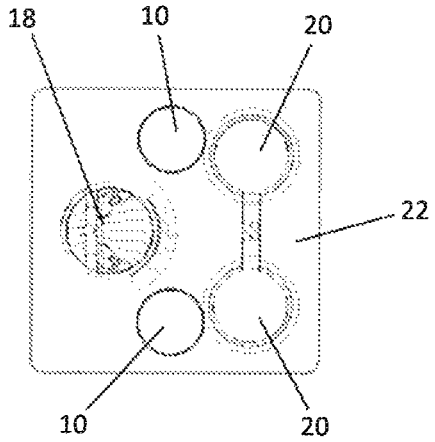
FIG. 3 shows an arrangement of a shark jaws and towing pins in combination with the present invention.
Figure 4:
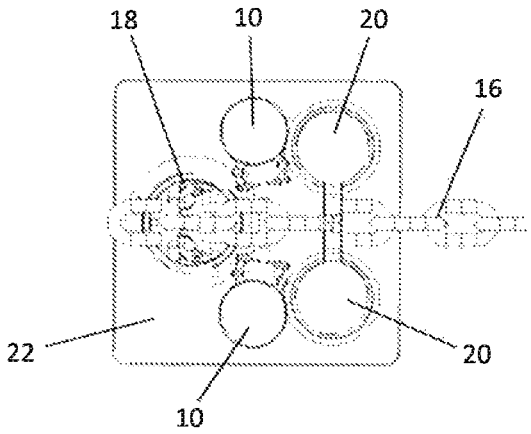
FIG. 4 shows an arrangement corresponding to FIG. 3, but comprising a chain.
Figure 5:
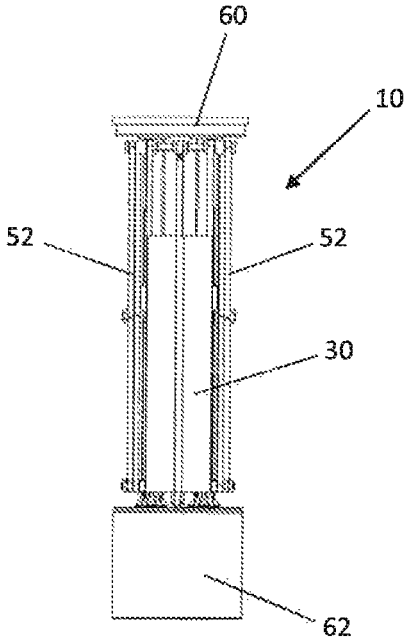
FIGS. 5 to 9 show different outlines of a disconnection unit according to the invention.
Figure 6:
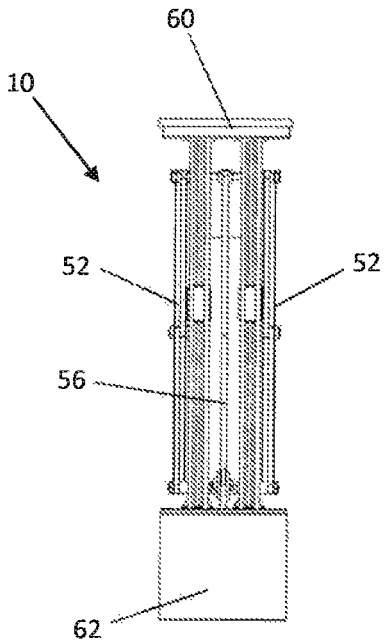

In the FIGS. 1-4 it can be seen that the present disconnection unit can be arranged on, or adjoining, a deck 14 at the aft end of a vessel 12. The invention is in particular developed for an anchor handling vessel, but can also be used on other vessels that handle a load or equipment connected to a chain, wire or the like.

The disconnection unit 10 is preferably placed adjoining a shark jaws 18 and towing pins 20, in particular if used on an anchor handling vessel, and can be integrated in the same box 22 as said shark jaws and towing pins are kept in. Furthermore, it can be appropriate to place a disconnection unit 10 on each side of the wire, chain, rope or the like 16 to which the load or equipment is fastened. It can also be desirable that the disconnection units are placed as near as possible to said shark jaws and towing pins. The unit 10 is preferably arranged so that it can be raised from and lowered into the deck of the vessel 14, and furthermore can be fitted with a lid or a cover 60 to seal against the deck when the disconnection unit 10 is lowered into the deck. Furthermore, the disconnection unit 10 can be placed on a plinth 62 and connected to pressure cylinders or the like (not shown) for said raising from and lowering into the deck.

The disconnection unit 10 is preferably formed as an extended unit with a rod mechanism 50 that is arranged to hold a housing 30 with an explosive part 32 against or adjoining the chain 16 (or wire or rope) that shall be cut. In its simplest form the disconnection unit can comprise a static unit which holds the explosive part against the chain permanently, but it is preferred that the disconnection unit is formed so that it can be released from an inactive position to an active, explosion activated state.

Figure 7:
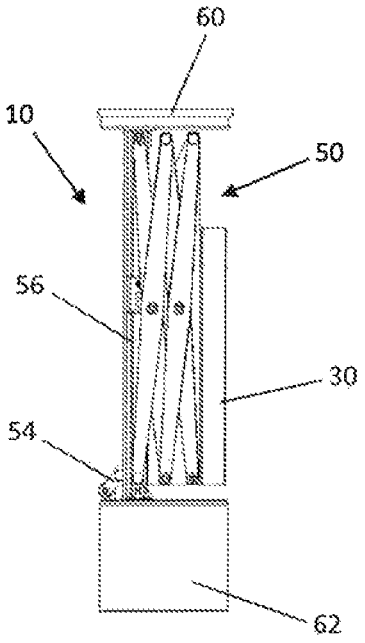
Figure 8:
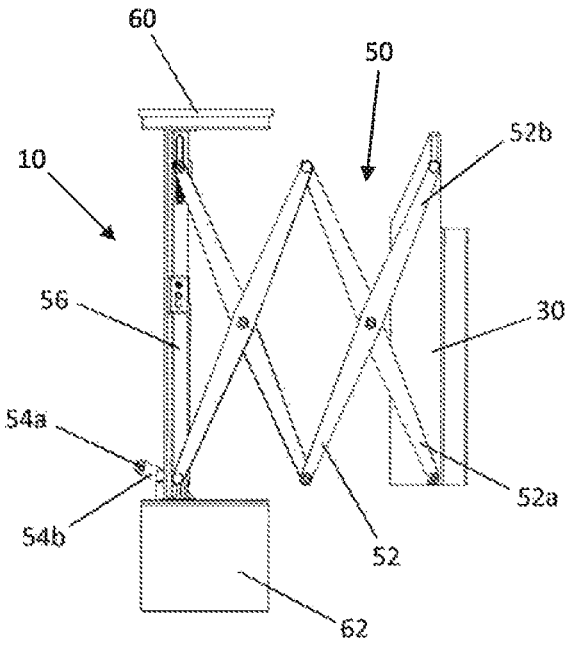

For the latter object, the rod mechanism 50 of the disconnection unit 10 is formed with a number of articulated arms 52 that can move the housing 30 from an inactive position, as shown in FIG. 7, to an active position where the housing is placed near the chain 16 that shall be cut, as shown in FIG. 8. In a preferred embodiment the articulated arms 52 are connected in pairs so that they form a "scissor-like" arrangement, and readily with several pairs of "scissor arms" connected after each other. How many or how long the articulated arms shall be will normally be determined by how near the chain, wire or rope that shall be cut the disconnection unit can be placed. The innermost pair of articulated arms and/or the innermost part of the articulated arms 52 is connected to a vertical rod or holding part 56 which extends up from the plinth 62. The rod or the holding part 56 is necessarily somewhat longer than each articulated arm 52 and can also have the cover 60 fitted at the top. The outermost pair of articulated arms and/or the outer part of the articulated arms 52 is connected to the housing 30.

Figure 9:
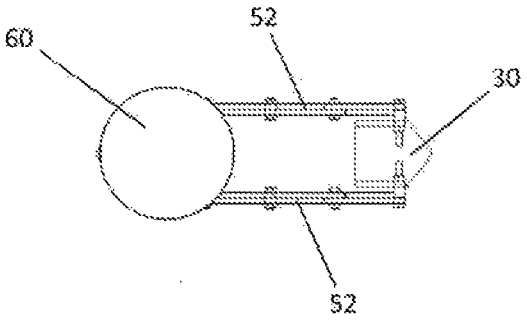

The disconnection unit 10 can be fitted with a set of articulated arms 52, as long as the housing with the explosive part 32 can be held stable at the chain 16 that shall be cut. Alternatively, the unit 10 can comprise two sets of articulated arms 52, as shown in FIG. 9, where the housing is thereby connected between the sets of articulated arms 52.

In the inactive position of the disconnection unit 10 the articulated arms 52 will, as for example shown in FIG. 7, be arranged to be biased, and the articulated arms can thereby quickly be released by the pre-stressing mechanism (not shown). The pre-stressing mechanism can be a spring or similar appliance that can provide a pushing force to the articulated arms 52. For the release of the pre-stressing mechanism and thus the articulated arms 52, the disconnection unit 10 can be fitted with a release mechanism 54 connected to the pre-stressing mechanism. The release mechanism can be, for example, in the form of a peg 54*b* with a locking wheel 54*a*, where the locking wheel is arranged to be released from a locking position. The locking position can be a guiding hole machined into the deck 14 of the vessel.

At the activation of the disconnection unit 10, this is moved upwards from the retracted position in the deck 14 and when the locking wheel 54*a* moves out of the locked position the peg 54*b* is moved to activate the pre-stressing mechanism so that the articulated arms 52 are driven outwards, whereupon the explosive 34 can be detonated.

The disconnection unit 10 can be fitted with a capsule (not shown) between the plinth 62 and the cover 60 and which also surrounds the articulated arm 52. However, the capsule must be fitted with a vertical slit through which the housing and the articulated arms can be taken out.

Figure 10:
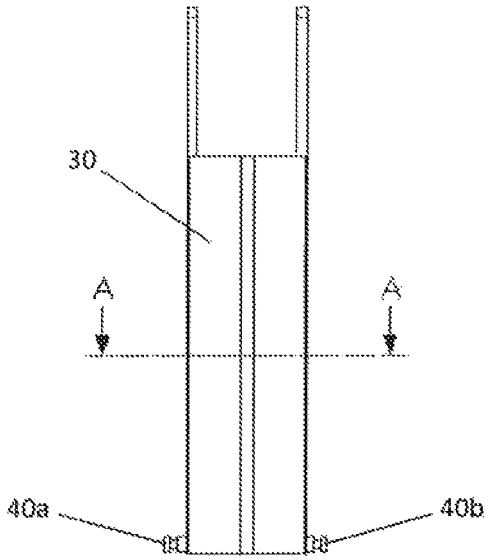
FIGS. 10 to 12 show outline and section, respectively, of a housing according to the present disconnection unit.
Figure 11:
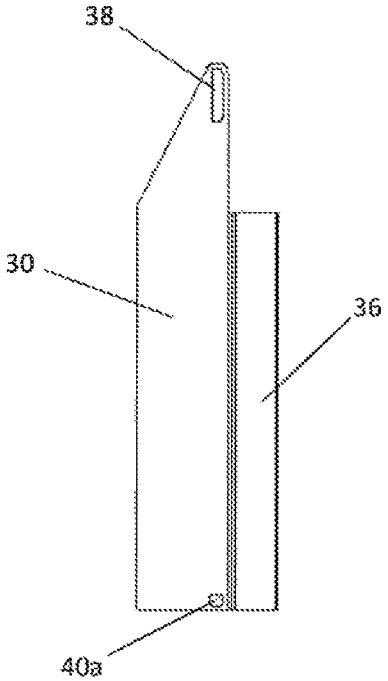
Figure 12:
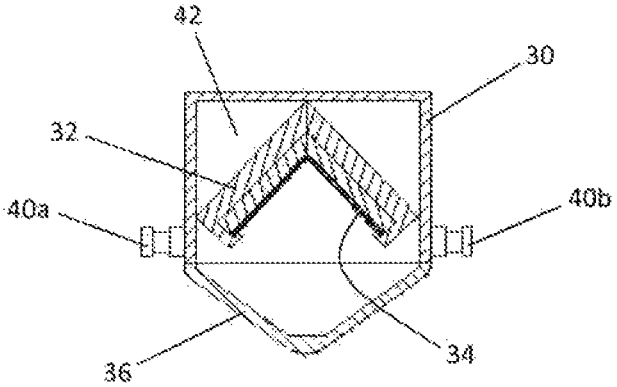

Reference is made to FIG. 12 which illustrates a cross-section along the line A-A in FIG. 10. The embodiment of the invention shows an extended assembly which comprises an extended, external housing 30 of a rigid and strong construction formed by a bottom and sidewalls, preferably made from steel. Furthermore, the housing 30 can comprise a layer 42 of a dampening material, for example, polyurethane of a uniform thickness. The housing 30 can be formed as given in NO 328744B1, or be formed in any other way and arranged to provide a directed explosion.

In the embodiment shown the housing 30 comprises fastening units for fastening to the articulated arms (the rod mechanism) in the form of a number of pegs 40*a* and 40*b* on each side of the lower part of the housing and a number of slits or grooves 38 in the upper part of the housing, where the pegs and the slits are arranged to be fastened to the articulated arms 52. As shown in FIG. 8, the articulated arms 52*a* and 52*b* are fastened to the respective pegs 40*a* and 40*b* and the slits 38.

Furthermore, the housing 30 comprises an explosive part 32, for example, in the form of an internal housing part formed by a bottom and sidewalls with a shape adapted to the internal form of the dampening material layer 42, if used, and which is preferably made from steel or other strong materials that can be of a uniform thickness and an explosive 32 that is made up from an extended explosive element and is formed to fill the internal housing part completely, or partially, and which has surfaces in a V-shape, whereby the V-shaped surfaces provide a V-formed hollow space for the formation of a hollow charge explosive which will lead to the shockwave, material and the heat from the detonated explosive being concentrated in the direction out of the V-shaped hollow space. A cover 36 with an inversed V-shape can be placed in the front of the V-shaped hollow space.

For the dampening, for example, by absorption of bi-products of the rapid reaction in the thermic reactive mass of the explosive, which, for example, is in the form of heat and pressure, it can be advantageous, as suggested above, to cover the unit 10 with a single, or multi-layer absorbing material that is arranged to take up some or the most essential of the bi-products. As mentioned, the housing is advantageously encapsulated so that a penetration of the goal material does not reduce the structural integrity of the construction of the invention or other parts of the surrounding construction, preferably so that an initiation of the rapid thermal reaction, for example, such as detonation, does not lead to any other effects that constitute a risk for near lying objects.

Simply described, the unit 10 can comprise an explosive charge 34, formed in a V-shape such as a knife blade, where the knife blade-like charge on detonation is driven through the cover 36 and through the chain, wire or rope that shall be cut.

The activation of the unit of the invention, which encompasses to detonate the thermic rapid reaction will, when it is installed on the aft deck of an anchor handling vessel (AH-vessel), provide a safety barrier which works to avoid a loss of crew or vessel in a case where a load that is connected to said chain, wire or the like, comes out of control in such a way that a danger arises for the vessel or the crew, and where the cutting of said chain, wire or the like can contribute to avoid or reduce such danger. Thus, when the disconnection unit is released, it can, in the embodiment shown, "jump" up from the deck, place the explosive near, for example, the chain and trigger the detonation so that the chain is cut immediately in a safe and secure way.

The invention claimed is:

1. A disconnection unit for instantaneous disconnection of a load connected to a vessel by a wire, cable, or chain designed to run on the topside of an assigned part or an open deck of a vessel, where the unit comprises a housing that contains an explosive part, said explosive part comprises at least one explosive unit formed as a directed charge with a blast-off side, and where the unit is arranged to extend above the deck of the vessel, wherein the disconnection unit comprises a rod mechanism for holding the housing with the explosive part adjoining said wire, cable, or chain above the deck, and which shall be cut, wherein the rod mechanism comprises a number of articulated arms, and that the housing with the explosive part is connected to respective articulated arms and wherein the articulated arms are arranged in pairs in a movable scissor position, whereby the housing with the explosive part in an inactive state is retracted in the unit and in an active state is extended from the unit.

2. The unit according to claim 1, wherein the disconnection unit comprises release mechanism arranged to release the extension of the articulated arms.

3. The unit according to claim 2, wherein the release mechanism is arranged to be released when the disconnection unit is raised above the deck of the vessel.

4. The unit according to claim 3, wherein the release mechanism comprises a peg with a locking wheel where the locking wheel is arranged to be released from a locking position.

5. The unit according to claim 2, wherein the release mechanism comprises a peg with a locking wheel where the locking wheel is arranged to be released from a locking position.

6. The unit according to claim 1, wherein the articulated arms, are arranged biased in the disconnection unit, when in an inactive state.

7. The unit according to claim 1, wherein the disconnection unit comprises two sets of a number of articulated arms, where the housing with the explosive part is arranged between respective outermost articulated arms to each set of articulated arms.

8. The unit according to claim wherein the housing is equipped with a number of pegs and a number of slits arranged for connection to said articulated arms.

9. An anchor handling vessel comprising a disconnection unit according to claim 1, wherein the vessel comprises shark jaws and towing pins; wherein the disconnection unit is arranged on or adjoining an aft end of the deck of the vessel wherein the disconnection unit is placed in an area between the shark jaws and towing pins of the vessel, where the housing with the explosive part is arranged to be held against a wire, cable, or chain that runs between said shark jaws and towing pins.

10. Anchor handling vessel according to claim 9, wherein the disconnection unit is integrated in a box with said shark jaws and towing pins.

11. Anchor handling vessel according to claim 9, wherein one disconnection unit is placed on each side of said wire, cable, or chain.

12. An anchor handling vessel comprising a disconnection unit according to claim 2, wherein vessel comprises shark jaws and towing pins; wherein the disconnection unit is arranged on or adjoining the aft end of the deck of the vessel, wherein the disconnection unit is placed in an area between the shark jaws and towing pins of the vessel, where the housing with the explosive part is arranged to be held against a wire, cable, chain that runs between said shark jaws and towing pins.

13. An anchor handling vessel comprising a disconnection unit according to claim 6, wherein the vessel comprises shark jaws and towing pins; wherein the disconnection unit is arranged on or adjoining the aft end of the deck of the vessel, wherein the disconnection unit is placed in an area between the shark jaws and towing pins of the vessel, where the housing with the explosive part is arranged to be held against a wire, cable, chain that runs between said shark jaws and towing pins.

14. An anchor handling vessel comprising a disconnection unit according to claim 7, wherein the vessel comprises shark jaws and towing pins; wherein the disconnection unit is arranged on or adjoining the aft end of the deck of the vessel, wherein the disconnection unit is placed in an area between the shark jaws and towing pins of the vessel, where the housing with the explosive part is arranged to be held against a wire, cable, chain that runs between said shark jaws and towing pins.

15. An anchor handling vessel comprising a disconnection unit according to claim 3, wherein the vessel comprises shark jaws and towing pins; wherein the disconnection unit is arranged on or adjoining the aft end of the deck of the vessel, wherein the disconnection unit is placed in an area between the shark jaws and towing pins of the vessel, where the housing with the explosive part is arranged to be held against a wire, cable, chain that runs between said shark jaws and towing pins.

16. An anchor handling vessel comprising a disconnection unit according to claim 5, wherein the vessel comprises shark jaws and towing pins; wherein the disconnection unit is arranged on or adjoining the aft end of the deck of the vessel, wherein the disconnection unit is placed in an area between the shark jaws and towing pins of the vessel, where the housing with the explosive part is arranged to be held against a wire, cable, chain that runs between said shark jaws and towing pins.

17. An anchor handling vessel comprising a disconnection unit according to claim 8, wherein the vessel comprises shark jaws and towing pins; wherein the disconnection unit is arranged on or adjoining the aft end of the deck of the vessel, wherein the disconnection unit is placed in an area between the shark jaws and towing pins of the vessel, where the housing with the explosive part is arranged to be held against a wire, cable, chain that runs between said shark jaws and towing pins.

* * * * *